US009284083B2

(12) United States Patent
Koch et al.

(10) Patent No.: US 9,284,083 B2
(45) Date of Patent: Mar. 15, 2016

(54) ARRANGEMENT AND METHOD FOR COUPLING SEVERAL GROUPS OF MACHINE ASSEMBLIES OF A CONTAINER PROCESSING DEVICE

(75) Inventors: Peter Koch, Seeon (DE); Franz Sigl, Kolbermoor (DE)

(73) Assignee: Krones AG, Neutraubling (DE)

( * ) Notice: Subject to any disclaimer, the term of this patent is extended or adjusted under 35 U.S.C. 154(b) by 1029 days.

(21) Appl. No.: 13/135,487

(22) Filed: Jul. 7, 2011

(65) Prior Publication Data

US 2012/0018035 A1 Jan. 26, 2012

(30) Foreign Application Priority Data

Jul. 20, 2010 (DE) ..... 10 2010 031 800

(51) Int. Cl.

| | |
|---|---|
| ***B65B 53/00*** | (2006.01) |
| ***B65B 53/02*** | (2006.01) |
| ***B65B 63/08*** | (2006.01) |
| ***B65B 53/06*** | (2006.01) |
| ***B65B 11/08*** | (2006.01) |
| ***B65B 59/04*** | (2006.01) |

(52) U.S. Cl.

CPC ..... *B65B 53/063* (2013.01); *B65B 11/08* (2013.01); *B65B 53/06* (2013.01); *B65B 59/04* (2013.01)

(58) Field of Classification Search

CPC .... B65B 31/02; B65B 31/028; B65B 31/025; B65B 51/32; B65B 55/025; B65B 55/027; B65B 2220/24; B65B 53/063; B65B 53/00; B65B 53/02; B29C 2049/4632; B29C 2049/697

USPC ..... 53/127, 440, 441, 442, 467, 556, 557

See application file for complete search history.

(56) References Cited

U.S. PATENT DOCUMENTS

| | | | | | |
|---|---|---|---|---|---|
| 3,727,324 | A | * | 4/1973 | Melgaard | 34/216 |
| 3,777,446 | A | * | 12/1973 | Graver | 53/442 |
| 3,897,671 | A | * | 8/1975 | Higgins | 53/442 |
| 4,139,979 | A | * | 2/1979 | Nakazato et al. | 53/298 |
| 4,172,873 | A | * | 10/1979 | Spicer | 264/230 |
| 4,270,283 | A | * | 6/1981 | Ellis | 34/212 |
| 4,541,225 | A | * | 9/1985 | Byland | 53/441 |
| 4,640,726 | A | * | 2/1987 | Sallee et al. | 156/85 |
| 4,872,302 | A | * | 10/1989 | van Eijsden et al. | 53/441 |
| 5,022,165 | A | * | 6/1991 | Beswick | 34/62 |

(Continued)

FOREIGN PATENT DOCUMENTS

| | | |
|---|---|---|
| CN | 101157395 | 4/2006 |
| CN | 201520424 | 7/2007 |

(Continued)

*Primary Examiner* — Stephen F Gerrity
*Assistant Examiner* — Eyamindae Jallow
(74) *Attorney, Agent, or Firm* — Davidson, Davidson & Kappel, LLC

(57) ABSTRACT

An arrangement of several machine assemblies (34, 38). The machine assemblies are arranged in a way that the material flow between the machine assemblies (34, 38) is at least technically mutually coupled. The machine assemblies are subsequently arranged to form treatment stations and/or processing stations of a machine (10) for processing, treatment and/or filling of containers. A method for coupling several machine assemblies (34, 38). The assemblies are subsequently arranged to form treatment stations and/or processing stations of a machine (10) for processing, treatment and/or filling of containers.

9 Claims, 2 Drawing Sheets

(56) References Cited

U.S. PATENT DOCUMENTS

| | | | | |
|---|---|---|---|---|
| 5,368,666 | A * | 11/1994 | Terada | 156/85 |
| 5,590,509 | A | 1/1997 | Esteves et al. | 53/432 |
| 6,643,998 | B1 * | 11/2003 | Curtis et al. | 53/594 |
| 6,648,634 | B2 * | 11/2003 | Nava | 432/121 |
| 6,834,473 | B2 * | 12/2004 | Wiedemann | 53/127 |
| 7,076,930 | B2 * | 7/2006 | Rimondi | 53/433 |
| 7,155,876 | B2 * | 1/2007 | VanderTuin et al. | 53/557 |
| 7,269,929 | B2 * | 9/2007 | VanderTuin et al. | 53/48.2 |
| 7,703,263 | B2 | 4/2010 | Reiner | 53/442 |
| 7,784,253 | B2 * | 8/2010 | Blome | 53/557 |
| 8,051,629 | B2 * | 11/2011 | Pazdernik et al. | 53/442 |
| 8,205,418 | B2 * | 6/2012 | Napravnik | 53/557 |
| 2004/0231301 | A1 * | 11/2004 | VanderTuin et al. | 53/557 |
| 2004/0237472 | A1 * | 12/2004 | De Cardenas et al. | 53/399 |
| 2004/0250515 | A1 * | 12/2004 | Rimondi | 53/451 |
| 2006/0137824 | A1 | 6/2006 | Hwang et al. | |
| 2006/0174432 | A1 | 8/2006 | Montabaur | 15/24 |
| 2009/0071107 | A1 * | 3/2009 | Ehrmann | 53/442 |
| 2010/0015269 | A1 * | 1/2010 | Matsushita et al. | 425/143 |
| 2010/0077702 | A1 * | 4/2010 | Lelie | 53/442 |
| 2010/0223889 | A1 * | 9/2010 | Napravnik | 53/442 |
| 2010/0236196 | A1 * | 9/2010 | Pazdernik et al. | 53/442 |
| 2013/0318926 | A1 * | 12/2013 | Py | 53/467 |

FOREIGN PATENT DOCUMENTS

| | | |
|---|---|---|
| CN | 201099362 | 8/2013 |
| DE | 69 23 340 | 12/1971 |
| DE | 80 26 838 U1 | 5/1981 |
| DE | 10 2004 038 839 | 2/2006 |
| DE | 20 2005 020 192 U1 | 5/2006 |
| DE | 10 2005 009 854 | 8/2006 |
| GB | 1425302 | 2/1976 |
| JP | 50-138991 | 11/1975 |
| WO | WO 2008/122311 | 10/2008 |

* cited by examiner

ARRANGEMENT AND METHOD FOR COUPLING SEVERAL GROUPS OF MACHINE ASSEMBLIES OF A CONTAINER PROCESSING DEVICE

This claims the benefit of German Patent Application DE 10 2010 031 800.0, filed Jul. 20, 2010 and hereby incorporated by reference herein.

The invention relates to an arrangement of several machine assemblies, whereby the material flow between the machine assemblies is at least technically mutually coupled. The invention furthermore relates to a method for coupling several machine assemblies that are subsequently arranged to form treatment stations and/or processing stations of a machine for processing, treatment and/or filling of containers.

BACKGROUND

Known container treatment machines or packaging machines use compressed air in different parts of the process. A container treatment machine that comprises a packaging module with a film wrapping device uses compressed air to correctly guide the transported film. The cut film sections are usually transported on a conveyor band in the direction of a further transport band of the film wrapping module. Blowing means are used to subject the conveyor band of the film wrapping module to low or negative pressure. In the further course the film has to cross a section where the support of the film cannot be ensured. Therefore this section has to be bridged to prevent a deviation of the film or a deviation of the beginning of the film. The film can especially deviate downwards because of gravitational forces. The film can also deviate upwards, e.g. because of electrostatic forces or the like. For the transport of the film an air channel can be formed by the use of blowing nozzles. Through the blowing nozzles the film is subjected to low or negative pressure holding the film to the conveyor band. Low or negative pressure is required for the conveyor band of the film separation module. In the further processing high pressure is required for the air assisted transport of the film. This leads to a relatively high consumption of compressed air. Furthermore the compressed air used by both systems requires a certain system pressure

SUMMARY OF THE INVENTION

An object of the present invention is to reuse the exhaust air. This can be done by a deviation of the exhaust air and/or another use of exhaust air generated by blowers and/or other sources for low or negative pressured air that are already used in the system. Thereby the energy balance of the container processing device should be improved and the amount of unused compressed air should be reduced, thereby reducing the amount of unnecessarily used energy.

The present invention provides an arrangement of several machine assemblies, whereby the material flow between the machine assemblies is at least technically mutually coupled. The present invention also provides a method for coupling several machine assemblies that are subsequently arranged to form treatment stations and/or processing stations of a machine for processing, treatment and/or filling of containers.

The present invention proposes arranging several machine assemblies in a way that the material flow between the machine assemblies is at least technically mutually coupled. The machine assemblies are subsequently arranged to form treatment stations and/or processing stations of a machine for processing, treatment and/or filling of containers. Each of the machine assemblies comprises components for air conveyance, air cooling and/or compressed air supply, whereby at least one of the machine assemblies is fed with exhaust air from one of the other machine assemblies. The machine assemblies can for example be parts of modules of a container forming system, whereby a filling system and a packaging system are arranged downstream of the container forming system. The several machine assemblies use compressed air as energy supply and/or the compressed air is used to assist the handling of the material or the transport of the film. The compressed air is usually spent and emitted to the surroundings without further use. The use of compressed air generally causes a relatively high expenditure of energy. The expenditure of energy can be reduced with the help of the invention. According to the invention not only the material flow between the different machine assemblies is coupled, but the machine assemblies are also coupled energetically. To achieve this, a module-spanning supply of compressed air is used, the supply being used for several of the different machine assemblies. Especially the exhaust air emerging from single modules or machine assemblies is used for at least one of the other modules or machine assemblies.

The exhaust air provided by at least one of the machine assemblies can be used as compressed air and/or as cooling air for machine parts and/or parts of the containers and/or of packaging means for the containers of another machine assembly.

In a useful embodiment the machine assembly provided with the exhaust air is a film shrinking station. The film shrinking station comprises conveying means for the transport of packs of several containers wrapped in film. The conveyor chains used in the film shrinking stations are permanently and cyclically heated. Before contacting a new pack, the conveyor chains have to be cooled down to prevent excessive softening of the packaging film at the contact surface between chain and pack. Excessive softening of the film in the contact surface area can lead to unwanted adhesion or sticking of the film to the conveyor chain.

In a further embodiment according to the invention the arrangement can comprise an endless circumferential conveyor chain that permanently runs through the film shrinking station. The conveyor chain is heated by the hot air used for heating the packs wrapped in film. The film shrinking station comprises a film shrinking section and a section outside the film shrinking section. The conveyor chain is cooled down with the exhaust air of one of the neighboring machine assemblies in a section outside the film shrinking section. In this way an effective cooling of the conveyor chain is possible, whereby no additional energy is required for the production of the cooling air.

Another useful embodiment of the invention comprises an intercooling device arranged between neighboring machine assemblies that are coupled to each other. The intercooling device cools down the exhaust air exchanged between the different machine assemblies. This is especially useful when the temperature of the exhaust air needs to be reduced before it can be used as cooling air. This energetic advantage is hereby unlimited because most of the energy is required for the production of the compressed air. The intercooling only requires little additional energy.

Furthermore a pressure boosting device can optionally or additionally be arranged between neighboring coupled machine assemblies. The pressure boosting device is used for increasing the pressure of the exhaust air exchanged between the machine assemblies. A pressure boosting device is a suitable compressor, a turbo compressor or the like.

In addition to the already described embodiments of the arrangement of several machine assemblies, the invention furthermore comprises a method for energetically coupling several machine assemblies. The arrangement is formed by treatment stations and/or processing stations of a machine for processing, treatment, filling and/or packaging of containers. The machine assemblies each comprises components for air conveyance, air cooling and/or compressed air supply, whereby at least one of the machine assemblies is fed with exhaust air of one of the other machine assemblies. Thereby the machine assemblies are connected by a technical material flow coupling as well as by an energetic coupling. By using exhaust air from one of the machine assemblies for another machine assembly as cooling air and/or as part of the compressed air supply, the energetically expensive production of cooling air and/or compressed air is not required for this associated module. According to a preferred embodiment of the method the exhaust air from at least one of the machine assemblies is therefore redirected and fed to another one of the machine assemblies to be used as compressed air supply and/or as cooling air supply of machine components and/or parts of containers and/or of packaging means for the containers.

The machine assembly provided with the exhaust air can for instance be a film shrinking station that comprises a conveying means for the transport of packs of several containers wrapped in film. The conveying means may especially be formed by a circumferential conveyor chain that permanently runs through the film shrinking station. In the film shrinking station the conveyor chain gets heated by the hot air used for heating the film wrapped packs. The conveyor chain is then cooled down outside the film shrinking section by exhaust air from a neighboring machine assembly. Because of the permanent thermal input in the film shrinking station, the conveyor chain is permanently heated. After some operating time this leads to problems because the chain gets too hot for the contacting film. The film at the contact surface would be heated too much, even before the wrapped pack is introduced into the shrinking tunnel. This leads to unwanted sticking of the film to the conveyor chain.

The exhaust air exchanged between neighboring coupled machine assemblies can either be intercooled and/or its pressure can be increased. The intercooling is required when the temperature of the exhaust air is too high to be used as cooling air. If exhaust air with a higher pressure or a higher air velocity is required for the further use in one of the machine assemblies, the pressure of the exhaust air can be increased by an interposed turbo compressor or radial compressor.

The present invention allows the reduction of the energy used in a container treatment machine that comprises several machine assemblies or modules connected by technical material flow coupling as well as by energetic coupling. To guarantee the correct transport of film in a film guiding device, compressed air is used. In a film separating device the cut film is usually transported via a transport band to a film wrapping station. A low or negative pressure is produced by a blower and impinged on the conveyor band of the film separating device. The film has then to be transported over a section where no support for the film can be guaranteed. Commonly a so called air bed is used to bridge this section and to prevent a deviation of the film or the beginning of the film. An air channel is generated by blowing air through several nozzles generating a so called "air bed conveyor." Low or negative pressure is required for the conveyor band of the film separation module. In the further processing high pressure is required for the air assisted transport of the film. This leads to a relatively high consumption of compressed air. Both systems furthermore require compressed air with a certain system pressure. Until now the exhaust air generated by the blowers was dispensed into the surroundings. Therefore the exhaust air was wasted and not furthermore used. One aspect of the invention describes the use of the exhaust air emitted by the blower of the film separation station. The exhaust air from the blower can be connected to the blowing nozzles or blowing tubes of the film separation station thereby at least partially replacing the compressed air used so far. The exhaust air from the blower can also be connected to the blowing nozzles or blowing tubes of a film spreading device, where it also at least partially replaces the compressed air used so far. For the described applications it might be necessary to increase the pressure of the exhaust air from the blower. The pressure can be increased by the use of a turbo compressor, a compressor or the like. It is especially useful to adjust the size of the used blower according to the compressed air required in the whole arrangement, especially including the amount of exhaust air required for the film separation station and/or for the spreading of the film.

An especially useful embodiment uses the largely pressure-free exhaust air for cooling of other components without consideration of any remaining pressure. For the cooling only the available volume stream is essential. There is no need to take the pressure conditions into consideration. This pressure-free exhaust air can be used for the cooling of conveyor chains in shrinking stations or shrinking tunnels. The hot air required for shrinking the film around the packs leads to a permanent thermal input into the conveyor chain. The conveyor chain is therefore heated significantly, which leads to problems during contact with the film wrapped around the packs. Therefore the conveyor chains are usually cooled. The exhaust air from other stations can advantageously be used for cooling of the conveyor chain.

BRIEF DESCRIPTION OF THE DRAWINGS

In the following passages, the attached figures further illustrate exemplary embodiments of the invention and their advantages. The size ratios of the individual elements in the figures do not necessarily reflect the real size ratios. It is to be understood that in some instances various aspects of the invention may be shown exaggerated or enlarged to facilitate an understanding of the invention.

DETAILED DESCRIPTION

Figure 1:
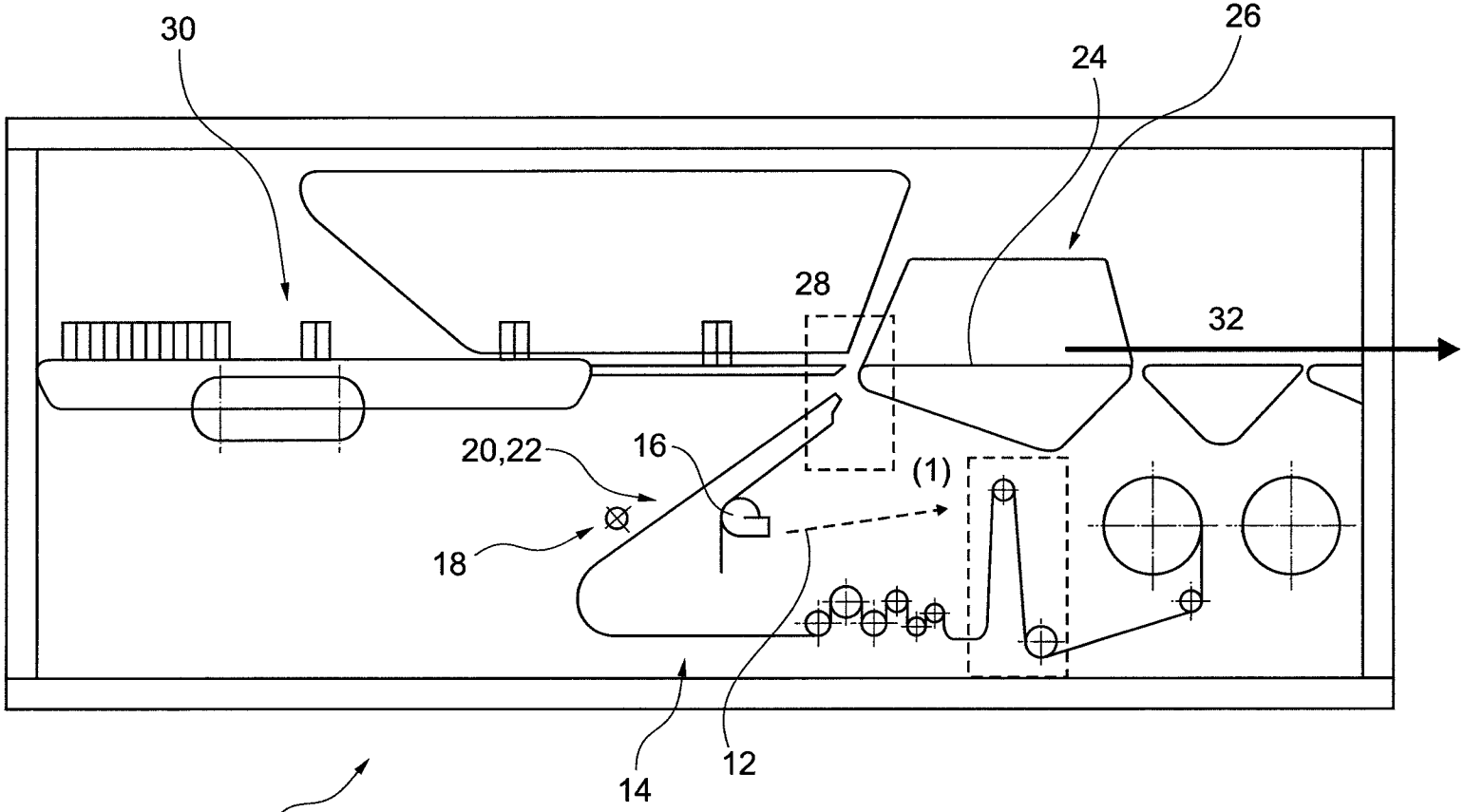
FIG. 1 illustrates a schematic longitudinal section of a packaging machine with an air-assisted film guiding unit.
Figure 2:
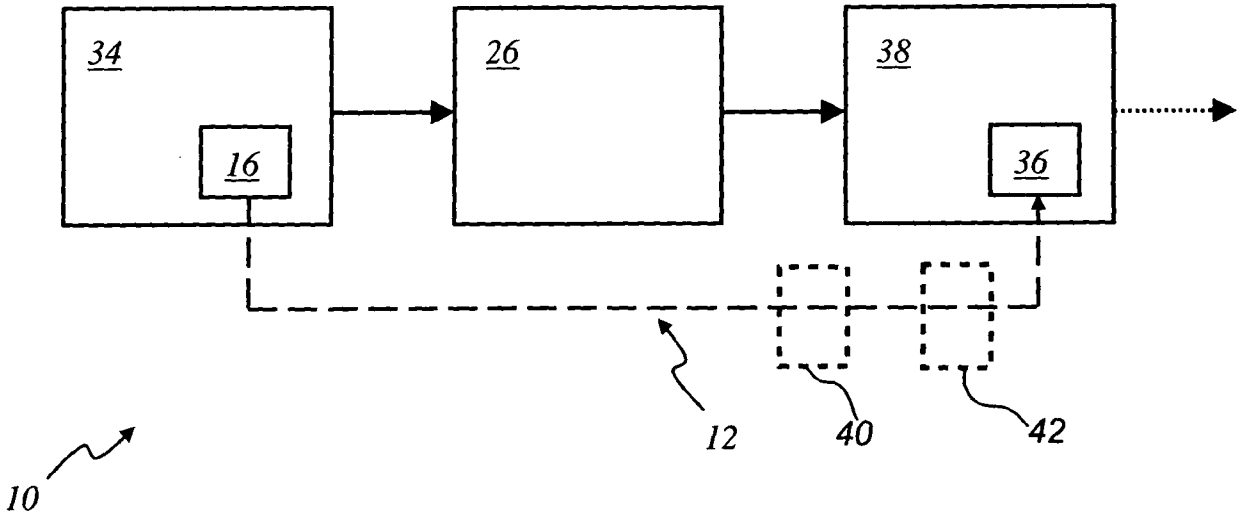
FIG. 2 illustrates a block diagram of a container handling unit, in which the material flow of several individual modules is coupled and that are furthermore energetically coupled.

The schematic representations of FIGS. 1 and 2 show embodiments according to the present invention. The same or equivalent elements of the invention are designated by identical reference characters. Furthermore and for the sake of clarity, only the reference characters relevant for describing the respective figure are provided. It should be understood that the detailed description and specific examples of the device and method according to the invention, while indicating preferred embodiments, are intended for purposes of illustration only and are not intended to limit the scope of the invention.

The schematic longitudinal section shown in FIG. 1 shows the use of exhaust air 12 according to the invention in a packaging machine 10. The exhaust air 12 is produced by an air supported film guiding unit 14. A blower 16 is used for the production of pressurized air in the film guiding unit 14 to ensure the correct transport of the film. In the film separation station 18 the cut film 20 is usually transported via a conveyor band 22 to a further transport band 24 of a film wrapping station 26. The conveyor band 22 of the film separation station 18 is impinged with low or negative pressure by a blower 16. The film 20 has then to be transported over a section 28 (see FIG. 1) where no support for the film 20 can be guaranteed. A so called "air bed conveyor" is generated by blowing air through several nozzles. This "air bed conveyor" is used to bridge the section 28 and to prevent a deviation of the film 20 or the beginning of the film 20 due to gravitational forces. Low or negative pressure is required for the conveyor band 22 of the film separation module 18. In the further processing high pressure is required for the air assisted transport of the film 20. This leads to a relatively high consumption of compressed air. The exhaust air 12 from the blower 16 is furthermore used and not just discarded into the surroundings. The further use of the exhaust air 12 is indicated by a dashed arrow 12 in FIG. 1.

FIG. 1 furthermore shows grouped articles 30 that are transported through a packaging machine 10 in a horizontal direction. In the film wrapping station 26 the grouped articles 30 are wrapped in film 20 and thereby packaged as units. The packaged units wrapped in film are transported in a horizontal direction (arrow 32, FIG. 1) to a shrinking station (38, see FIG. 2). The film is shrunk onto the grouped articles by the application of heat, thereby creating a tight film-container-compound. The articles 30 can be beverage containers made from PET or something alike.

The schematic block diagram illustrated in FIG. 2 represents a container handling unit 10, in which the material flow of several individual modules is coupled and in which the individual modules are furthermore energetically coupled. In the shown embodiment the container handling unit 10 comprises a film transporting module 34 that feeds film sections into the subsequently arranged film wrapping module 26. In the film wrapping module 26 grouped articles (see FIG. 1) are wrapped in film. As already described above, the film transporting module 34 comprises a blower 16 that produces pressurized air that is used for the film conveyance. The exhaust air 12 from the blower 16 is almost pressure free, but it can be used advantageously for the cooling of other components. Hereby only the volume flow of available exhaust air 12 is of importance. The pressure of the exhaust air 12 is hereby irrelevant. In the shown embodiment the exhaust air 12 is used for the cooling of the conveyor chains 36 in a shrinking station 38 or in a shrinking tunnel. In this section the conveyor chain 36 gets heated by the permanent thermal input of hot air required for fixing the film around the packs. This can lead to problems in the areas of the conveyor chain directly contacting the film. The cooling of the conveyor chains 36 is done with the exhaust air 12 from the blower 16 of the film transport module 34.

Optionally, an intercooler 40 can cool down the air 12 or a pressure booster 42 can increase the pressure of air 12.

The packs wrapped in shrinking film can be further processed or handled in subsequently arranged modules, e.g. the packs can be arranged on pallets by a palletization module, the packs can be transported to a storage unit or the like. This further processing is only hinted by the broken arrow on the right side of the shrinking station 38.

The invention has been described with reference to a preferred embodiment. Those skilled in the art will appreciate that numerous changes and modifications can be made to the preferred embodiments of the invention and that such changes and modifications can be made without departing from the spirit of the invention. It is, therefore, intended that the appended claims cover all such equivalent variations as fall within the true spirit and scope of the invention.

LIST OF REFERENCE SYMBOLS

10 packaging machine
12 exhaust air
14 film guiding unit
16 blower
18 film separation module
20 film
22 conveyor band
24 transport band
26 film wrapping station
28 section of film transport
30 article
32 transport direction (packs)
34 film transporting module
36 conveyor chain
38 shrinking station
40 intercooler
42 pressure booster

What is claimed is:

1. An arrangement of several machine assemblies, the arrangement comprising:

a first machine assembly and a second machine assembly arranged subsequent to the first machine assembly and receiving material from the first machine assembly, the first and second machine assemblies forming processing stations of a machine for processing of containers;

each of the first and second machine assemblies including components for at least one of air conveyance, air cooling and compressed air supply, the first machine assembly including a blower providing air to transport a film, the second machine assembly being fed with exhaust air from the blower; and a pressure boosting device arranged between the neighboring coupled first and second machine assemblies, the pressure boosting device increasing the pressure of the exhaust air from the blower and providing the compressed exhaust air to the second machine assembly for use in a film shrinking station downstream of the first machine assembly, the pressure boosting device being a compressor or a turbocompressor.

2. The arrangement as recited in claim 1 wherein the exhaust air provided by the first machine assembly is used as at least one of a compressed air supply and cooling air for at least one of machine parts, container parts, and a packager for the containers of the one of the first and second machine assemblies.

3. The arrangement as recited in claim 1 wherein the film shrinking station including a conveyor for transport of packs of several containers wrapped in film.

4. The arrangement as recited in claim 3 wherein the conveyor includes a circumferential conveyor chain permanently running through the film shrinking station, the conveyor chain being heated by hot air used for heating the film wrapped packs and the conveyor chain being cooled in a section outside a film shrinking section by the exhaust air of the first machine assembly.

5. The arrangement as recited in claim 1 further comprising an intercooling device arranged between the first and second machine assemblies, wherein the intercooling device cools down the exhaust air exchanged between the first and second machine assemblies.

6. A method for coupling several machine assemblies subsequently arranged to form processing stations of a machine for processing of containers, each of the machine assemblies comprising components for at least one of air conveyance, air cooling and compressed air supply, the machine assemblies including a first machine assembly including a blower providing air to transport a film and a second machine assembly including a film shrinking station downstream of the first machine assembly, the method comprising:

feeding the second machine assembly with exhaust air of the blower; and increasing the pressure of the exhaust air of the blower and providing the compressed exhaust air to the second machine assembly for use in the film shrinking station, the pressure being increased by a pressure boosting device arranged between neighboring coupled first and second machine assemblies of the machine assemblies, the pressure boosting device being a compressor or a turbocompressor.

7. The method as recited in claim 6 wherein the exhaust air from the blower is redirected and used as compressed air supply or cooling air supply of machine components or parts of containers or of a packager for the containers.

8. The method as recited in claim 6 wherein the film shrinking station including a conveyor for transport of packs of several containers wrapped in film, the conveyor including a circumferential conveyor chain permanently running through the film shrinking station, the conveyor chain being heated by the hot air used for heating the film wrapped packs and the conveyor chain being cooled in a section outside the film shrinking section by the exhaust air of the neighboring one machine assembly.

9. An arrangement of several machine assemblies, the arrangement comprising:

a first machine assembly and a second machine assembly arranged subsequent to the first machine assembly and receiving material from the first machine assembly, the first and second machine assemblies forming processing stations of a machine for processing of containers;

each of the first and second machine assemblies including components for at least one of air conveyance, air cooling and compressed air supply, the first machine assembly including a blower providing air to transport a film, the second machine assembly being fed with exhaust air from the blower; and a means for pressure boosting arranged between the neighboring coupled first and second machine assemblies, the means for pressure boosting increasing the pressure of the exhaust air from the blower and providing the compressed exhaust air to the second machine assembly for use in a film shrinking station downstream of the first machine assembly.

* * * * *